United States Patent [19]

de Concini

[11] 4,396,358

[45] Aug. 2, 1983

[54] ELECTRIC FUEL PUMP FOR USE IN THE FUEL INJECTION SYSTEM OR A SPARK-IGNITION INTERNAL COMBUSTION ENGINE

[75] Inventor: Roberto de Concini, Bologna, Italy

[73] Assignee: Weber S.p.A., Milan, Italy

[21] Appl. No.: 260,551

[22] Filed: May 5, 1981

[30] Foreign Application Priority Data

May 8, 1980 [IT] Italy ..... 3411 A/80

[51] Int. Cl.[3] ..... F04B 49/08; F04B 39/06

[52] U.S. Cl. ..... 417/310; 417/366; 29/597

[58] Field of Search ..... 417/366, 410, 423 R, 417/199 A, 201, 203, 205, 310; 29/597

[56] References Cited

U.S. PATENT DOCUMENTS 4,134,712 1/1979 Kemmner et al. ..... 417/366

4,231,719 11/1980 Ringwald et al. ..... 417/410

4,314,796 2/1982 Terauchi ..... 417/310

*Primary Examiner*—Richard E. Gluck

*Attorney, Agent, or Firm*—Sughrue, Mion, Zinn, Macpeak & Seas

[57] ABSTRACT

An electrically-operated fuel pump is provided for supplying fuel to the fuel injection system of a spark-ignition I.C. engine. The pump comprises a casing wherein there is located a small electric motor and a rotary pumping assembly. The rotor of the motor is drivingly coupled to the impeller of the pumping assembly. The pump also includes a pressure relief valve for preventing the build up of excessive pressures within the casing, and a non-return valve provided at the pump outlet. The pump casing serves not only as a fuel containment member and a mechanical supporting structure, but also as the magnetic frame of the motor stator.

11 Claims, 8 Drawing Figures

ELECTRIC FUEL PUMP FOR USE IN THE FUEL INJECTION SYSTEM OR A SPARK-IGNITION INTERNAL COMBUSTION ENGINE

BACKGROUND OF THE INVENTION

1. Field of the Invention

The invention relates to an electro-mechanically operated pump for feeding fuel, at a substantially constant pressure of several atmospheres, to supply ducts of a fuel injection system of a spark-ignition internal combustion engine.

2. Description of the Prior Art

Electrically-operated fuel pumps are known in which the impeller of a rotary pumping assembly is arranged to be driven in rotation by a small electric motor such as to cause a fuel to be fed from the fuel tank to the fuel injection system, the capacity of the pump being sufficient to cope with the largest fuel consumption rate which the engine may demand. Such pumps may incorporate a pressure-relief valve to prevent excessive pressures building up in the pump due to a malfunction in the fuel injection system.

Pumps of this type which are in current production generally suffer from one or more of the following problems:

- difficulty in assembly of the parts of which the pump is composed coupled with high costs of assembly due to the necessity of assembling the components of the pump in several stages;
- difficulty of centering the axes of rotation of the small electric motor and the impeller of the pump; and
- difficulty in positioning and dimensioning the pressure relief valve both considered as a single unit and as a component of the pump as a whole.

It is an object of the present invention to provide an improved electric fuel pump.

SUMMARY OF THE INVENTION

According to the present invention there is provided an electrically-operated fuel pump for use in the fuel injection system of a spark-ignition internal combustion engine, said pump comprising:

- a tubular casing with respective means defining a fuel input at one end of said casing and a fuel output at the opposite end of the casing,
- a spindle and two spaced supports mounting the spindle longitudinally within said casing,
- an electric motor housed within said casing and comprising a stator and a rotor carried on said spindle,
- a pumping assembly arranged within said casing and including a rotatably mounted impeller, said impeller being supported on said spindle and being drivingly coupled to the rotor of the motor,
- electrical connection means for supplying electric current to the said motor, and
- first valve means for preventing the build up of excessive pressure in the fuel contained in the casing, and second valve means for preventing the return flow of fuel back through said fuel output, said casing as well as serving as a containment member for the fuel and a mechanical support structure for the components of the pump, also constituting the magnetic frame of the stator of the electric motor.

BRIEF DESCRIPTION OF THE DRAWINGS

An electric fuel pump embodying the invention will now be specifically described, by way of non-limitative example, with reference to the accompanying diagrammatic drawings, in which.

DESCRIPTION OF THE PREFERRED EMBODIMENT

The electric fuel pump now to be described is intended for use in the fuel injection-system of a spark-ignition internal combustion engine.

Figure 1:
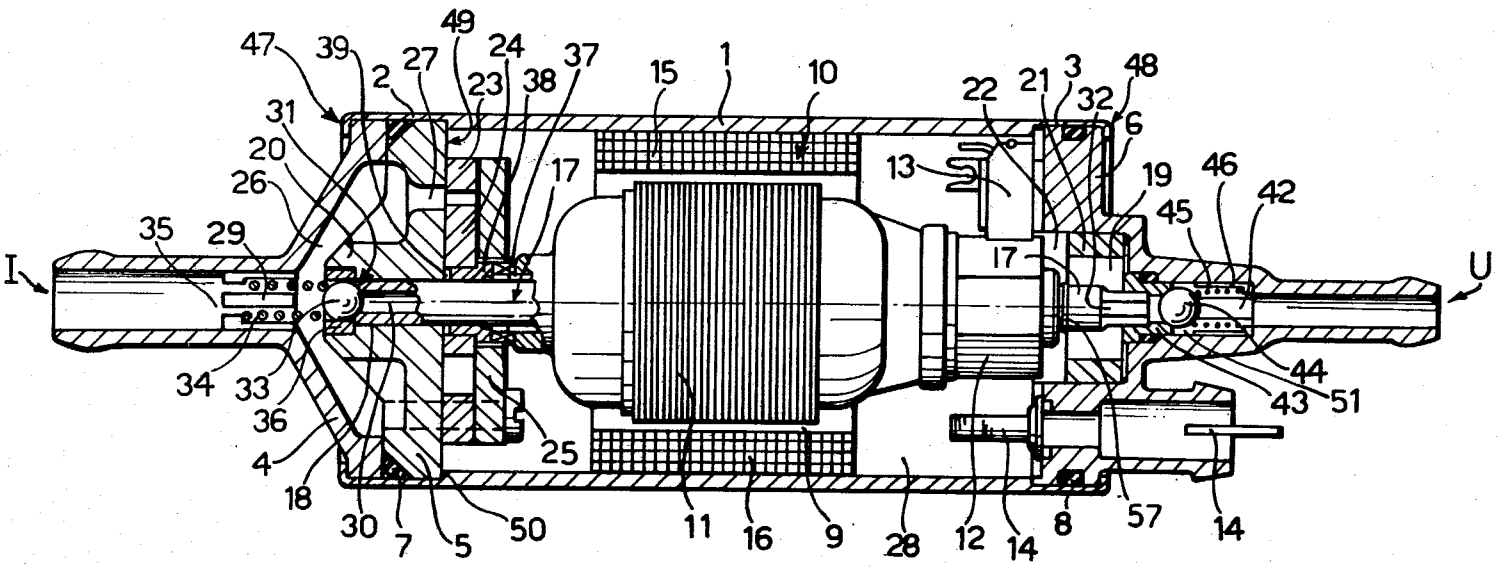
FIG. 1 is a longitudinal section of the assembled pump.
Figure 2:
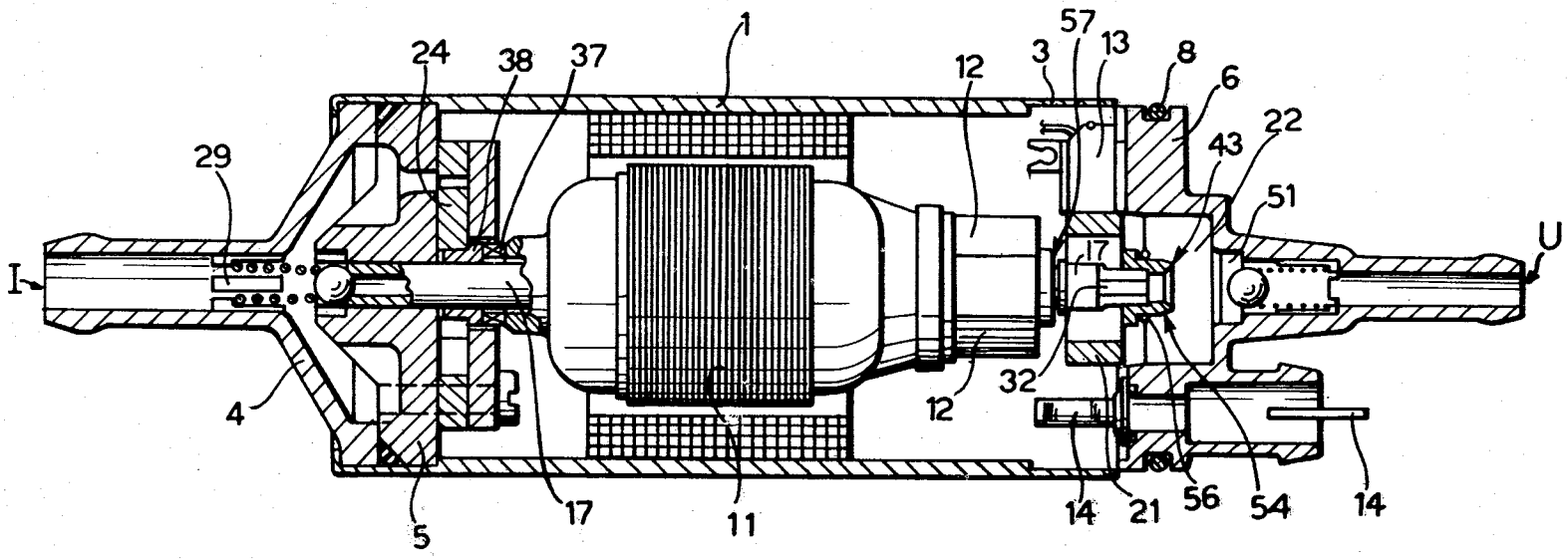
FIG. 2 is a longitudinal section of the pump at a particular stage during its assembly.

As shown in FIGS. 1 and 2, the pump comprises a cylindrical casing 1, an electro-magnetic assembly 9 located within the casing 1 and constituting a d.c. electric motor, and a pumping assembly 5 driven by the electric motor. The cylindrical casing 1 is internally formed with two cylindrical seating surfaces 2 and 3 respectively located adjacent the right and left end of the casing as viewed. These two cylindrical surfaces 2 and 3 constitute centering seats for components of the pump inserted into the corresponding ends of the casing 1.

The centering seat 2 serves to support a fuel-input end cap 4 and the pumping assembly 5 while the seat 3 supports a fuel-output end cap 6. The end cap 6 also serves as a brush holder unit mounting the current-supply brushes 13 of the d.c. electric motor of the pump. The interface between each centering seat 2 and 3 and the corresponding end cap 4 and 6 is sealed in liquid-tight manner by a respective sealing ring 7 and 8 whereby to enable the interior of the casing 1 to be sealed off from the surrounding environment. The end caps 4 and 6 are respectively formed with spigots defining a fuel input I and a fuel output U.

The electro-magnetic assembly 9 comprises a stator 10, a rotor 11, and a commutator 12 slidingly engaged by the brushes 13 carried by the end cap 6. The brushes 13 are urged against the commutator by conventional resilient means (not shown) and are connected to the external electrical supply circuit by an electrical connector 14 mounted in the end cap 6. The stator 10 is formed by two permanent magnets 15 and 16 of ferromagnetic material which are lodged within the casing 1 facing the rotor 11. The magnets 15 and 16 constitute opposite pole shoes of the electric motor and the casing 1 serves as the magnetic frame or yoke of the stator and is accordingly composed of a material suitable for the purpose. The rotor 9 is carried on a spindle 17 and is traversed by the magnetic flux generated by the permanent magnets 15 and 16. Upon energisation, the rotor 11 is arranged to rotate between the pole shoes about the axis of the spindle 17. The spindle 17 is itself mounted between a support 18 constituted by a base member 20 of the pumping assembly 5, and a centering bush 21 inserted in a cavity 22 of the output end cap 6.

The axis of the spindle 17 is also the axis of rotation of the pumping assembly 5 which is in itself conventional and is constituted by the said base 20, a stator 23, an impeller 24 having small rollers, and an end plate 25. On its low-pressure side, the pumping assembly 5 communicates via a first slot-like aperture 27 with a cavity 26 which is fed with fuel from the fuel inlet I. On its high-pressure side, the pumping assembly communicates with the interior 28 of the pump casing 1 through a second aperture (not shown) which is located in the end plate 25. The interior 28 of the pump communicates with the fuel output U of the pump via a non-return valve the structure of which will be described hereinafter.

Since the illustrated pumping assembly 5 is of standard form, its construction and functioning will not be described in detail and it is merely noted that the impeller 24 is coupled to the rotor 11 and, when rotated thereby, produces a continuous flow of fuel from the cavity 26 into the interior 28 of the pump. The flow rate of fuel from the pump input I to the pump output U is determined by the speed of rotation of the impeller 24, while the fuel delivery pressure is determined by the torque transmitted to the impeller 24 by the rotor 11.

In order to avoid an excessive build up of pressure inside the casing 1, the pump is provided with a pressure relief valve operative to allow a reverse flow of fuel from the high-pressure to the low-pressure side of the pumping assembly 5 when the pressure differential thereacross reaches a certain predetermined level. By arranging for the spindle to be hollow, the relief valve 29 can be implemented in a very simple, economical and effective manner as will become apparent from the following description of the valve 29.

The passage 30 constituted by the hollow interior of the spindle 17 has an outlet 31 close to the cavity 26, and an inlet 32 which opens, within the pump, into the pressurised fuel on the high-pressure side of the pumping assembly 5; for constructional reasons the inlet 32 opens out into the interior of the centering bush 21. The pressure relief valve 29 is located at the outlet 31 of the passage 30 and is constituted by a ball 33 which under the urging of a spring 34 is normally arranged to close off the outlet 31 by abutment against the end face of the spindle 17. At its end remote from the ball 33, the spring 34 is supported by a grooved spring holder 35.

The ball 33 is housed in a recess 36 in the pump base 20 in such a way that, in the event of displacement of the ball 33 from its closure position due to excessive pressure in the pump interior 28, the ball 33 does not move to a position from which it cannot return to close the outlet 31 once the pressure in the casing has returned to its normal working value. If during use of the pump, a malfunction occurs in the associated apparatus which results in an abnormal rise in the pressure downstream of the pump output U, the pressure in the pump interior will also rise due to the continued operation of the pumping assembly 5 and the fact that the non-return valve at the pump outlet will be closed. The pressure in the pump interior is transmitted through the passage 30 to the surface of the ball 33 facing the passage 30. Upon the pressure in the pump reaching a predetermined value the ball 33 will be displaced from its sealing position which results in the interior 28 of the pump being placed in direct communication with the low pressure cavity 26, thereby relieving the excess pressure.

Figure 3:
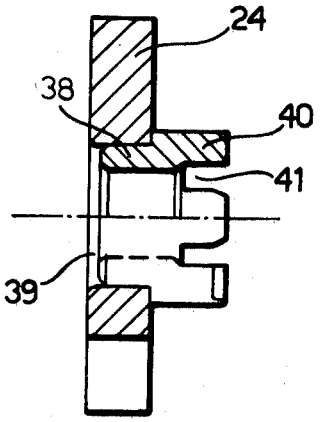
FIG. 3 is a detail of a dog tooth coupling used to transmit drive from the electric motor to the pumping assembly of pump.

In the present embodiment, the means used to drivingly interconnect the impeller 24 of the pumping assembly 5 with the rotor 11 of the electric motor, comprises a dog tooth coupling between the left-hand end part 37 of the rotor 11 (as viewed in FIG. 1) and a bush 38 inserted into an axial hole 39 in the impeller 24 in such a manner as to be rigidly connected thereto. As is illustrated in FIG. 3, the part of the dog-tooth coupling associated with the bush 38 is formed integrally therewith and takes the form of four projections 40 and four recesses 41 which are respectively inserted into, and house, complementary recesses and projections of the same dimensions which are rigidly connected to the rotor 11. In this way, the rotor 11 and the impeller 24 are connected together in a manner which is both simple and free of assembly problems.

The output end cap 6 which supports the brushes 13 and the electrical connector 14, is formed as a single piece and defines the cavity 22 in which the spindle-supporting bush 21 is lodged. The end cap 6 is also formed with a housing 42 in which is located the aforesaid non-return valve, this valve being constituted by a valve seat element 43, a ball 44, and a spring 45 reacting between the ball 44 and a grooved spring holder 46.

The bush 21 supports the spindle 17 by means of four radial ribs which permit the spindle 17 to be supported without obstructing the flow of fuel from the interior 28 of the pump towards the output spigot U.

The assembly of the various components of the pump will now be described with reference to FIG. 2. As a first step, the pump assembly 5 is assembled by fitting together the base 20, the stator 23, the impeller 24, and the end plate 25. The bush 38 is connected to the impeller 24. The spindle 17 is then inserted into the pump assembly 5 until its left hand end reaches the recess 36. Next the rotor 11 of the motor is mounted on the spindle 17 taking care to engage the part of the dog tooth integral with the bush 38 with the cooperating part 37 of the rotor.

To prevent the disengagement of the cooperating parts of the dog-tooth coupling, a resilient ring 57 is positioned on the right-hand end of the spindle 17 to prevent the rotor 11 from moving axially along the spindle. The unit formed by the pumping assembly 5, the spindle 17 and the rotor 11, is now inserted into the left-hand end of the casing 1 until the flat face 49 of the pump base 20 abuts against the casing shoulder which bounds one side of the centering seat 2; it should be noted that at this time, the casing 1 does not have its ends bent over to form the retaining flanges 47 and 48 illustrated in FIG. 1, so that the base 20 is free to enter the left-hand end of the casing.

Next, the sealing ring 7 is placed in position and the ball 33 is positioned in the recess 36 with the spring 34 on top. Assembly of the left-hand end of the pump is then completed by insertion of the end cap into the casing until it contacts the base 20 of the pump assembly 5; this contact between the end cap 4 and base 20 ensures not only the compression of the sealing ring 7, but also the correct degree of precompression of the spring 34 of the pressure relief valve 29. The assembled parts of the pump are retained in position by the bending over of the left-hand end of the casing to form the retaining flange 47.

At this stage during the assembly procedure, the output end cap 6 and its associated brushes 13 are yet to be mounted in the pump. The problem which now presents itself is that of keeping the brushes 13 spaced apart so as to allow their correct positioning on the commutator 12 of the motor 9 since there is no means of keeping them spaced apart from the outside. To overcome this problem, the parts to be located in the centering seat 3 are so designed as to make subsequent positioning of the brushes 13 on the commutator 12 possible. The parts concerned are the end cap 6 and the bush 21 supported thereby, and the structure of these parts is considered in greater detail below.

As already mentioned, the unitary end cap 6 serves as the brush holder unit and is formed with a cavity 22 arranged to house the centering bush 21. The end cap 6 is also formed with a cavity 51, adjacent the cavity 22, which is arranged to receive the seat element 43 of the non-return valve. The cavity 51 is situated in the housing 42 of the end cap 6 and communicates with the pump output U.

Figure 5:
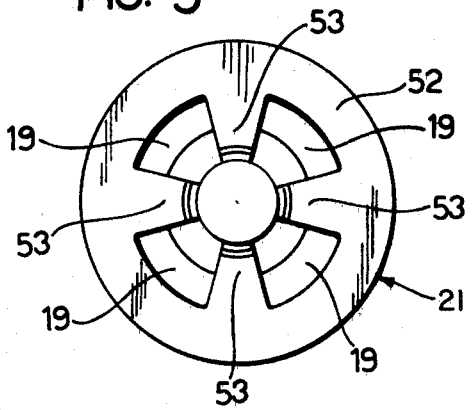
FIGS. 5, 6, 7, 8 are respectively a front elevation, an axial section, a rear elevation and a side view of a bush used to support a spindle which carries the rotating components of the electric motor and pumping assembly.

The bush 21 (FIG. 5) includes an annular part 52 the outer diameter of which is very slightly greater than the outer diameter of the commutator 12. The inner cylindrical wall of the annular part 52 has an inner diameter and carries the four spindle-supporting ribs 53 already mentioned. These ribs 53 subdivide the central space 19 of the annular part 52 into four zones through which fuel can pass on its way towards the output U of the pump.

Figure 6:
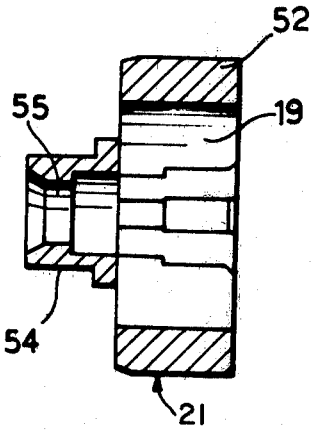
Figure 7:
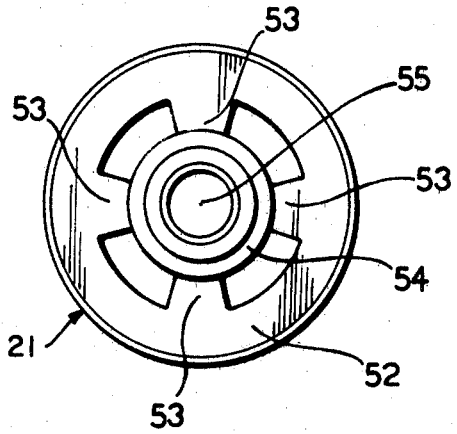
Figure 8:
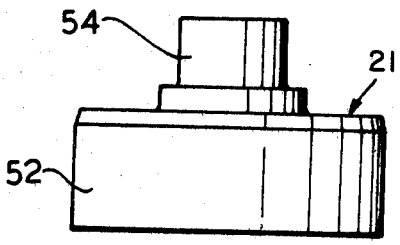

On its side intended to face away from the rotor 1, the bush 21 is provided with a cylindrical projection 54 which is supported by the radial ribs 53 (FIGS. 6 and 7). This projection 54 has an axial passage 55 through which fuel is arranged to flow in passage between the pump interior and the outlet U when the pump is in operation. The main function of this projection 54 is to support the valve seat element 43 of the previously mentioned non-return valve during assembly.

In the assembly stage which immediately precedes that illustrated in FIG. 2, the components of the non-return valve are first inserted into the housing 42 of the end cap 6. Thereafter a sealing ring 56 is placed around the projection 54 of the bush 21 and the end cap 6 and the bush 21 are the assembled together in such a manner that the brushes 13 rest on the outer cylindrical face of the bush 21 and are centralised thereby. Next, the end cap 6 and bush 21 are fitted over the right-hand end of the spindle 17 (as viewed in FIG. 2) until the spindle 17 seats in the support defined by the radial ribs 53; the mutual positioning of the pump components at this stage during assembly is illustrated in FIG. 2.

The outside of the end cap 6 is now pushed to displace the cap 6 towards the left relative to the bush 21 which does not move because it is already engaged with the end of the spindle 17. This leftward movement of the cap 6 results not only in the end cap 6 lodging in the centering seat 3 and the bush 21 becoming housed in the cavity 22, but also in the brushes 13 moving from their spaced-apart position on the bush to come to rest on the commutator 12. In this manner, the brushes 13 are readily assembled in position on the commutator 12 in sliding contact therewith.

Finally, the right hand end of the casing 1 is bent down to form the retaining flange 48 which holds the end cap 6 in position with its inner face up against the annular shoulder bounding the inner end of the seat 3.

From the foregoing, it will be apparent that the casing 1 serves not only as a fuel containment member and as a mechanical supporting structure for components of the pump, but also as the magnetic yoke of the stator of the motor.

Figure 4:
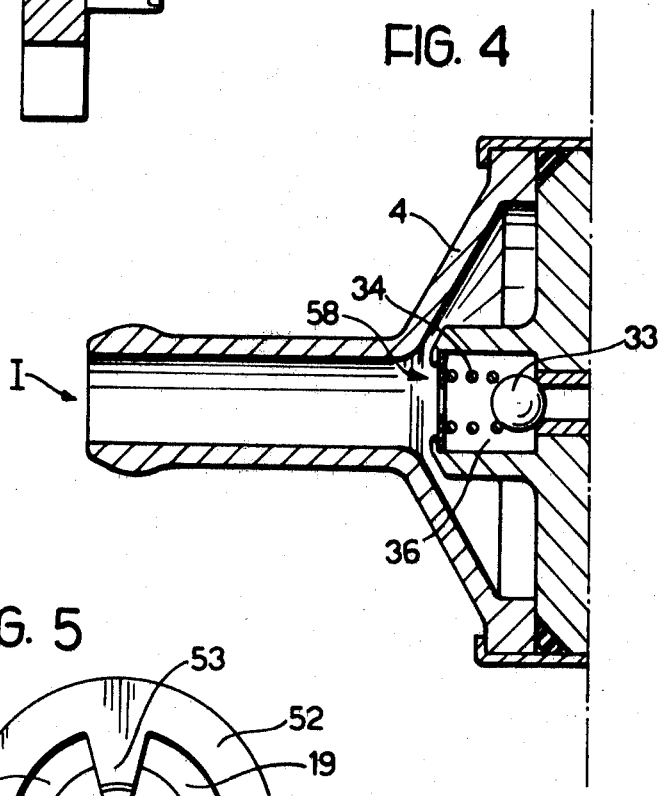
FIG. 4 is a variant of a pressure relief valve incorporated in the FIG. 1 pump.

The above-described and illustrated pump is, of course, only one of the possible embodiments of the invention. Among the possible modifications to the described pump, the pressure relief valve 29 may be modified as illustrated in FIG. 4. In this constructional variant, the valve is formed entirely within the base 20 of the pump 5, with both the valve ball 33 and the valve spring 34 being located in the cavity 36. As can be seen, in the FIG. 4 arrangement, the extent of the cavity 36 is greater in the FIG. 1 pump. At the left hand end of the cavity 36, there is disposed an apertured washer 58 which serves to support the spring 34. The FIG. 4 configuration of the pressure relief valve 29 offers greater ease of assembly than that of FIG. 1.

In a further variant of the FIG. 1 pump, the projection 54 is formed separately from the bush 21 and is preassembled in the space 51 of the output end cap 6.

We claim:

1. An electrically-operated fuel pump for use in the fuel injection system of a spark-ignition internal combustion engine, said pump comprising:

a tubular casing with respective means defining a fuel input at one end of said casing and a fuel output at the opposite end of the casing, a spindle and two spaced supports mounting the spindle longitudinally within said casing, an electric motor housed within said casing and comprising a stator, and a rotor carried on said spindle, a pumping assembly arranged within said casing and including a rotatably mounted impeller, said impeller being supported on said spindle and being drivingly coupled to the rotor of the motor, electrical connection means for supplying electric current to the said motor, and first valve means for preventing the build up of excess pressure in the fuel contained in the casing, and second valve means for preventing the return flow of fuel back through said fuel output, said casing as well as serving as a containment member for the fuel and a mechanical supporting structure for the components of the pump, also constituting the magnetic frame of the stator of the electric motor, wherein said spindle is formed with an internal longitudinal passage, said passage having an outlet which opens into the low-pressure side of the pumping assembly adjacent the fuel input, and an inlet which opens into the interior of the pump on the high-pressure side of the pumping assembly, the said first valve means being situated adjacent the said outlet of the passage and being constituted by a valve closure member in the form of a ball and a spring arranged to urge the ball towards the passage outlet whereby to close off this latter, and wherein said pumping assembly comprises, in addition to said impeller, a base part and a stator supported thereby, said base part being formed with a cavity having a first portion wherein the said ball of the first valve means is located, and a second portion wherein one end of the spindle is supported with the said outlet of the spindle passage facing towards the said first portion of the cavity.

2. A fuel pump according to claim 1, wherein the said means defining a fuel input is constituted by a first end cap and the said means defining a fuel output is constituted by a second end cap, said tubular casing being internally formed at each end thereof with a respective centering seat one of which serves to support the first end cap and the pumping assembly and the other of which serves to support the second end cap.

3. A fuel pump according to claim 2, wherein said electric motor includes a set of brushes for the supply of electric current to the rotor, the said brushes and the said electrical connection means being electrically connected to each other and being mounted on the second end cap.

4. A fuel pump according to claim 2, wherein the said second end cap is formed in a single piece and defines two co-axial cavities which communicate with one another and respectively house one of said spindle supports and the second valve means, the cavity housing the second valve means being in direct communication with the fuel output.

5. A fuel pump according to claim 1, wherein said first valve means further comprises a grooved spring holder which forms part of the said means defining the fuel input and is arranged to seat one end of the said spring.

6. A fuel pump according to claim 1, wherein the first valve means is housed wholly within the first portion of the cavity formed in the base part, the first valve means further comprising an apertured washer disposed across the end of the first cavity portion remote from the the second cavity portion, said apertured washer serving to support one end of the valve spring.

7. A fuel pump according to claim 1, wherein the said electric motor is a d.c. electric motor provided with a commutator fast for rotation with the rotor, and with brushes in sliding contact with the commutator and electrically connected to said electrical connection means, the said means defining the fuel output being in the form of an end cap and one of the said two spindle supports being constituted by an annular element, said annular element being supported by said end cap and having an outer diameter which is slightly greater than the diameter of the commutator of the electric motor whereby, during assembly of the fuel pump, the brushes of the motor can be initially disposed around said annular element and thereafter axially displaced onto the commutator.

8. A fuel pump according to claim 7, wherein said end cap defines two coaxial cavities which communicate with each other and respectively house the said spindle-supporting annular element and the second valve means, the cavity housing the second valve means communicating directly with said fuel output.

9. A fuel pump according to claim 8, wherein the said annular element carries an axially apertured cylindrical projection, the end cap further defining a third cavity which is disposed between the two other cavities and serves to house said cylindrical projection, the end surface of said projection which faces towards the cavity housing the second valve means constituting a valve seat thereof.

10. A fuel pump according to claim 9, wherein an annular sealing element is provided around said cylindrical projection, said sealing element being compressed between the internal surface of the end cap and the cylindrical projection.

11. A fuel pump according to claim 1, wherein the rotor is coupled to the said impeller by a dog tooth coupling one part of which is fast with the rotor and the other part of which is integral with a bush rigidly connected to the impeller.

* * * * *